United States Patent [19]

Sayles

[11] Patent Number: 4,961,384

[45] Date of Patent: Oct. 9, 1990

[54] HYPERVELOCITY PENETRATOR FOR AN ELECTROMAGNETIC ACCELERATOR

[75] Inventor: David C. Sayles, Huntsville, Ala.

[73] Assignee: The United States of America as represented by the Secretary of the Army, Washington, D.C.

[21] Appl. No.: 841,086

[22] Filed: Feb. 18, 1986

[51] Int. Cl.[5] ..... F42B 12/04; F42B 12/08; B64G 1/00

[52] U.S. Cl. ..... 102/519; 244/158 A

[58] Field of Search ..... 102/514–519, 102/501, 703; 244/158 A

[56] References Cited

U.S. PATENT DOCUMENTS

| | | | |
|---|---|---|---|
| 4,340,197 | 7/1982 | Campbell | 244/3.1 |
| 4,384,528 | 5/1983 | Moore et al. | 102/519 |
| 4,392,624 | 7/1983 | Myer | 244/158 A |

FOREIGN PATENT DOCUMENTS

| | | | |
|---|---|---|---|
| 51375 | 5/1982 | European Pat. Off. | 102/519 |
| 73385 | 3/1983 | European Pat. Off. | 102/519 |

*Primary Examiner*—David H. Brown

*Attorney, Agent, or Firm*—Freddie M. Bush; James T. Deaton

[57] ABSTRACT

A hypervelocity penetrator for an electromagnetic accelerator that includes a nosetip section that is made of a composite material that is ablative, an intermediate section of a heavy metal such as tungsten or tungsten alloy, and a rear section that is made of ultrahigh-strength material such as steel alloy with the rear section being hollow to provide a cone-shaped penetrator that has a center of gravity that is forward of the center of pressure of the penetrator structure.

3 Claims, 1 Drawing Sheet

HYPERVELOCITY PENETRATOR FOR AN ELECTROMAGNETIC ACCELERATOR

DEDICATORY CLAUSE

The invention described herein may be manufactured, used, and licensed by or for the Government for governmental purposes without the payment to me of any royalties thereon.

BACKGROUND OF THE INVENTION

In the past, various penetrators have been provided, however they do not have such structural integrity as to stand up under high G loadings and therefore a penetrator that is capable of withstanding high G's in the endoatmosphere is needed.

Accordingly, it is an object of this invention to provide a penetrator that has the capability of withstanding high G acceleration of the order of 100,000 200,000 G's.

Another object of this invention is to provide a projectile that has aerodynamic stability as opposed to spinstabilization.

Another object of this invention is to provide a penetrator that is made of a plurality of materials to provide a non-uniform density.

Still another object of this invention is to provide a penetrator that has the ability to accommodate ultrahigh aerodynamic heating and ablation.

A still further object of this invention is to provide a penetrator that has a higher than normal ballistic coefficient.

Other objects and advantages of this invention will be obvious to those skilled in this art.

SUMMARY OF THE INVENTION

In accordance with this invention, a hypervelocity projectile is provided which is made of three sections that include a nose tip portion of a composite material, an intermediate backup material section and a rear section of high strength material such as steel. The three sections are friction fitted together and in some applications could also be bonded together. This penetrator provides a structure that has a center of gravity forward of the center of pressure due to the materials that are used for the invironment to which the penetrator is to be exposed and due to the high G loading involved. The nose tip is fabricated to maximize anticipated recession caused by ablation.

DESCRIPTION OF THE PREFERRED EMBODIMENT

Figure 1:
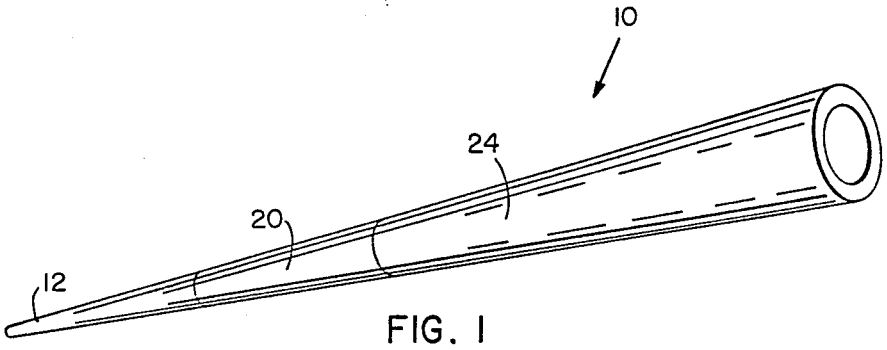
FIG. 1 is a perspective view of a penetrator in accordance with this invention.

Referring now to the drawings, a penetrator 10 in accordance with this invention is provided that includes a nose tip section 12 that is of a spherically-tipped cone configuration. That is, the tip end of the cone has a spherical shape at 14. Tip section 12 is made of an ablative type composite material and is preferably made of threedimensionally reinforced, fine-weave, carbon-carbon material. Nose tip section 12 has a reduced diameter section 16 for reception in bore 18 of intermediate section 20. Reduced diameter portion 16 is press fitted into bore 18 of intermediate section 20. Intermediate section 20 is preferably made of a material such as tungsten or of a tungsten alloy to provide a density of about 1200 lbm/ft$^3$ Intermediate section 20 also has a reduced diameter portion 22 that is press fitted into a bore of rear member 24. Rear member 24 is a hollow member with a frustrum of a cone to form the rear portion of the penetrator. This rear section 24 is preferably made of an ultrahigh-strength material such as alloy steel. A preferred alloy steel is Maraging steel M-300 with a density of 490 lbm/ft$^3$. The penetrator structure in accordance with this invention has a center of gravity 26 that is located forward of the center of pressure 28 of this penetrator's structure. A preferred length for the penetrator is about 2 inches for the nosetip section 12, about 1.9 inches for intermediate section 20 and about 5.22 inches for rear section 24 to provide an overall length of about 9.12 inches. Other lengths of the penetrator could be provided depending upon the particular application, but the ratios of the length of each of the sections should remain about the same or that set forth supra. With a length of about 9.12 inches, the thickness of the rear most section 24 should be about 0.14 inches with the radius at the rear of the cone being about 0.675 inches. The angle of the cone section is preferably about 4 degrees.

The unguided penetrator of this invention has been specially developed for use with an electromagnetic accelerator or launcher, and with a capability of being launched at velocities in excess of 5 Km/s. This penetrator differs radically from conventional gun-launched or rocket launched projectiles because, as an illustration, the projectile is exposed to major differences in environments during use at ultrahigh velocity.

Characteristics of this penetrator which point up differences from regular projectiles are as follows:

a. higher ballistic coefficient,
b. aerodynamic stabilization rather than spinstabilization,
c. non-uniform density,
d. ability to survive extremely high launch loads and accelerations,
e. ability to accommodate ultrahigh aerodynamic heating and ablation.

Additional explanations of these particular characteristics are as follows:

1. The ballistic coefficient of at least 2000 lbm/ft$^2$ of this hypervelocity penetrator is markedly higher than that of conventional projectiles. This is a very significant factor influencing its structure because the drag forces acting on the projectile with a low ballistic coefficient are slowed by atmospheric drag more than projectiles with a high ballistic coefficient. In addition, for a particular intercept altitude, projectiles have a lower intercept velocity, as a result of a lower ballistic coefficient, and must be more massive to deliver the necessary momentum onto the target to effect a kinetic energy kill. A high ballistic coefficient* is also necessary from the standpoint of minimizing the time-of-flight and to maximize accuracy and impact velocity.

* Ballistic Coefficient is defined as: $Beta = M/C_D A$ where $M$ = mass
$C_D$ = drag coefficient
$A$ = base area 2. This hypervelocity penetrator is aerodynamically stabilized rather than spin-stabilized, as is the case with conventional gun-launched munitions where spin is imparted by the rifling of the gun barrel, in combination with the rotating, or obturating, band. At the velocities, encountered in an electromagnetic accelerator, spinning of the penetrator is impractical because the rotating band cannot take the rifling at these velocities.

3. The penetrator is composed of several different materials, and, as a consequence, is not of uniform density. One reason for this is that aerodynamic stability requires that it have a positive static margin (i.e., that the center of gravity be forward of the center of pressure). A uniform, solid, slender sphere-cone would have a negative static margin.

4. The penetrator must be able to survive the launch loads imposed by the electromagnetic accelerator, and these are of the order of 100,000 to 200,000 G's. By contrast, a conventional projectile which is launched from a tank cannon is normally only exposed to about 10,000 G's.

5. The penetrator must be able to accommodate the aerodynamic heating, and ablation, conditions to which it is exposed during its flight through the endoatmosphere. The severe aerothermal conditions require that the penetrator's nosetip materials be selected to minimize ablation. A three-dimensionally reinforced, fine-weave, carbon-carbon (3-DCC) is used for this purpose since this has been found to experience significantly less linear surface regression than tungsten. In addition, the ablation of tungsten is less predictable, and more irregular than is the situation with three-dimensional carbon-carbon. It has been found that the nosetip recession is a small fraction of the total penetrator length, the cone angle is smaller, and the ballistic coefficient undergoes less change. In addition, the length of the nosetip section is designed to be 150% of the maximum anticipated recession to allow for its attachment to the penetrator body and for the uncertainties due to ablation prediction.

The structure that has been arrived at for the hypervelocity penetrator of this invention is therefore a slender, spherically-tipped cone configuration, and it offers several advantages over several minimum-drag shaped projectiles for applicant's purpose.

Figure 2:
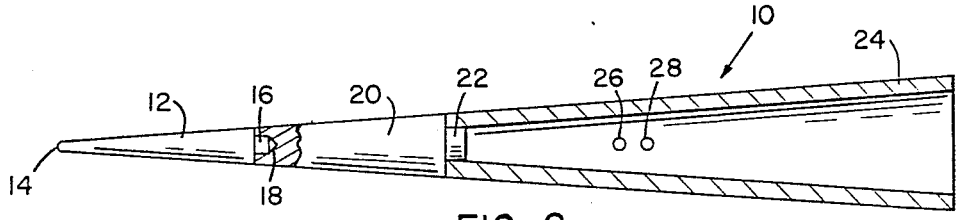
FIG. 2 is a sectional view of the penetrator in accordance with this invention.
Figure 3:
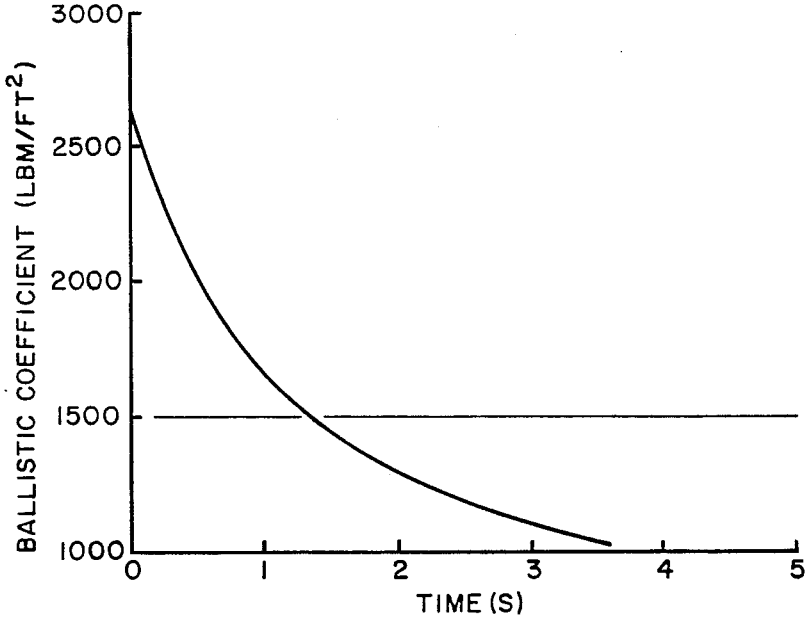
FIG. 3 is a graph illustrating the ballistic coefficient history of an unguided penetrator in accordance with this invention.

The optimum projectile configuration that has been determined is illustrated in FIGS. 1 and 2. Its specific properties are summarized in Table I below, and its ballistic coefficient history is plotted in FIG. 3. Although the initial ballistic coefficient is about 2700 lbm/ft$^3$, it drops to about 1000 lbm/ft$^3$ at 10 Km range. This decrease in ballistic coefficient is due to the effects of blunting and the decrease in Mach number. As a result, the average ballistic coefficient for this penetrator is about 1500 lbm/ft$^3$.

TABLE I

| CHARACTERISTICS OF AN UNGUIDED, HYPERVELOCITY ELECTROMAGNETICALLY-LAUNCHED PENETRATOR | |
|---|---|
| AVERAGE BALLISTIC COEFFICIENT (LBM/FT$^3$) | 1500 |

TABLE I-continued

| CHARACTERISTICS OF AN UNGUIDED, HYPERVELOCITY ELECTROMAGNETICALLY-LAUNCHED PENETRATOR | |
|---|---|
| MASS (G/LBM) | 366/0.087 |
| STATIC MARGIN (%) | 3.0–4.5 |
| BASE LOADNG (PSI/G) | 1.51 |
| INTERFACE LOADING (PSI/G) | 1.21 |
| AREAL DENSITY (LBM/FT$^2$) | 81 |
| MAXIMUM NOSETIP RECESSION (IN) | 1.3 |

The following is a detailed description of a particular unguided, hypervelocity, electromagnetically-launched penetrator of this invention:

The penetrator front section 12 undergoes a change from the initial spherical configuration, following a very rapid transition, to a 45° conic with a 0.01 inch radius spherical vertex as the penetrator is fired.

The backup material in intermediate section 20 is tungsten (or tungsten alloy) having a density of 1200 lbm/ft$^3$. Its selection is due to the fact that it results in the maximization of the ballistic coefficient, and ensures that the center of gravity 26 is located as far forward as possible, and overcomes the problem of distance between the center of pressure 28 and the center of gravity 26 because the nosetip material is of a low density.

The base material in rear section 24 is an ultrahigh-strength steel alloy (such as Maraging Steel M-300) with a density of 490 lbm/ft$^3$. The selection of this material is due to the fact that this component must be very strong in order to support the penetrator launch loads, and of low density to ensure that the center of gravity 26 is as far forward as possible.

I claim:

1. A hypervelocity penetrator for an electromagnetic accelerator comprising a cone shaped structure that includes a nosetip section that is made of an ablative composite material and having an outer tapered surface, an intermediate section that is telescoped with an secured to said nosetip section and having an outer tapered surface that is a continuation of the same taper of said outer tapered surface of said nosetip section, said intermediate section being made of a material that has a density of about 1200 lbm/ft$^3$, and a rear most section that is hollow and made of a material that has strength of margaring steel with a density of about 490 lbm/ft$^3$ and having an outer tapered surface that is a continuation of the same taper of said outer tapered surface of said intermediate section, said rear most section being telescoped with and secured to said intermediate section, and said penetrator structure having a center of gravity which is forward of a center of pressure for the penetrator structure.

2. A hypervelocity penetrator for an electromagnetic accelerator as set forth in claim 1, wherein said nosetip section has a tip end with a spherical shape and said nosetip section being made of three-dimensional reinforced, fine-weave carbon-carbon material, said intermediate section being made of tungsten or a tungsten alloy, and said rear most section being made of steel alloy.

3. A hypervelocity penetrator for an electromagnetic accelerator as set forth in claim 2, wherein said cone shaped structure outer tapered surfaces have a taper angle of about 4 degrees.

* * * * *